United States Patent [19]

Nukada

[11] Patent Number: 4,772,768

[45] Date of Patent: Sep. 20, 1988

[54] SMALL, LOW-POWER SWITCH HAVING INTEGRAL INSULATING AND CONDUCTIVE PORTIONS

[75] Inventor: Teisuke Nukada, Tokyo, Japan

[73] Assignee: Nihon Kaiheiki Industrial Company, Ltd., Tokyo, Japan

[21] Appl. No.: 480,682

[22] Filed: Mar. 31, 1983

[51] Int. Cl.[4] ..... H01H 9/04

[52] U.S. Cl. ..... 200/305; 200/339; 174/35 R

[58] Field of Search ..... 200/293, 304, 305, 339, 200/264; 174/35 R, 35 C, 35 G, 35 GC, 55 G, 51

[56] References Cited

U.S. PATENT DOCUMENTS

| | | | |
|---|---|---|---|
| 3,166,688 | 1/1965 | Rowland et al. | 138/103 X |
| 3,317,698 | 5/1967 | Mansfield | 200/305 X |
| 3,473,087 | 10/1969 | Slade | 138/103 X |
| 3,601,568 | 8/1971 | Sorenson | 200/304 |
| 3,862,382 | 1/1975 | Glaister et al. | 200/262 |
| 4,074,100 | 2/1978 | Hults et al. | 200/334 |
| 4,109,126 | 8/1978 | Halbeck | 200/305 |
| 4,110,583 | 8/1978 | Brown | 200/305 |
| 4,336,529 | 5/1982 | Buan | 200/305 X |

FOREIGN PATENT DOCUMENTS

| | | | |
|---|---|---|---|
| 2094553 | 9/1982 | United Kingdom | 200/305 |

*Primary Examiner*—Henry J. Recla
*Assistant Examiner*—Ernest G. Cusick
*Attorney, Agent, or Firm*—Burns, Doane, Swecker & Mathis

[57] ABSTRACT

A small, low-power switch, such as a toggle switch, includes a plastic housing which surrounds a switching contact assembly and provides a mounting for an electrically conductive handle. To ensure adequate grounding of the handle, the housing is made of two parts. A first portion made of insulating plastic surrounds the switching contact assembly and insulates it from the handle, as well as other components. A second portion made of conductive plastic is integrally molded to the first portion and is in electrical contact with the handle. The second portion also includes suitable structure for adapting the switch to be mounted on, or otherwise connected to, a grounded conductor, to thereby ground the handle.

5 Claims, 2 Drawing Sheets

SMALL, LOW-POWER SWITCH HAVING INTEGRAL INSULATING AND CONDUCTIVE PORTIONS

FIELD OF THE INVENTION

The present invention relates to the design of a small switch, e.g. a toggle switch, and more particularly to a construction of such a switch that assures adequate insulation of the switching contact assembly from exterior structure or components, while at the same time providing a ground connection to an electrically conductive handle.

DESCRIPTION OF THE PREFERRED EMBODIMENT

The Prior Art

Figure 1:
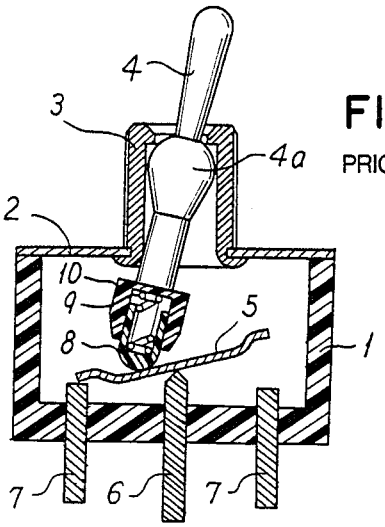
FIG. 1 PRIOR ART
FIG. 1 is a sectional side view of a prior art switch.

Referring to FIG. 1, a toggle switch of conventional construction includes a switch case, or housing, 1 of insulating plastic. A cover plate 2 of iron or stainless steel is fitted on the upper surface of the case 1, and a bushing 3 made of brass is fixedly attached at its lower end portion to the cover 2 at a centrally positioned circular hole. A generally vertically oriented lever-shaped handle 4 made of brass protrudes from either side of the bushing 3 and is pivotable to the right and left, as viewed in the Figure.

A converter 10 of insulating plastic is connected to the lower end of the handle 4. The connection of the converter and the handle can be such that, for example, a rod shaped projection formed centrally on the upper surface of the converter 10 is inserted and fitted into an upward recess correspondingly formed on the lower end portion of the handle 4. A plunger 8 of insulating plastic is inserted into a recess formed in the lower surface of the converter 10, there being interposed between them a spring 9 made of steel, such as piano wire.

A central stationary contact member 6 and right and left stationary contact members 7 are fixedly mounted in the bottom wall of the case 1 and penetrate therethrough. A movable contact member 5 is pivotably mounted on the upper end of the contact member 6. Namely, the contact member 6 serves as a bearing member for the movable contact member 5. The contact member 6 can be made of copper or a copper alloy while the contact members 5 and 7 are made of silver, copper or a copper alloy. The plunger 8 is translatable on the movable contact member 5 in the right and left directions. The outer surface of the bushing 3 is threaded, by means of which the switch can be mounted on a panel 11 in the manner shown in FIG. 3.

Figure 2:
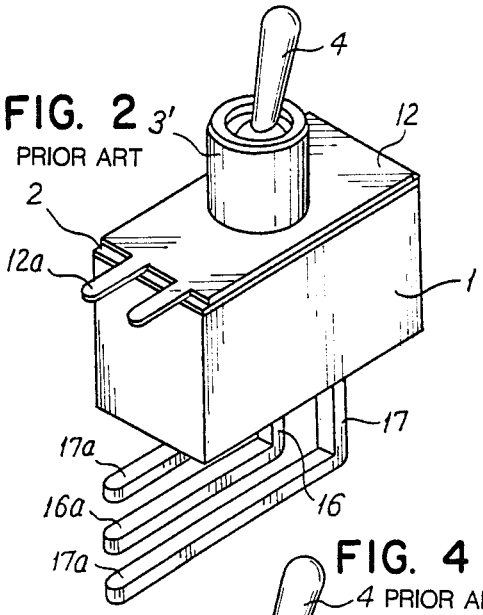
FIG. 2 PRIOR ART
FIG. 2 is a perspective view of another type of prior art switch.

FIG. 2 also shows a prior art switch which is a so-called switch for a printed substrate, or circuit board. In order to mount the switch on the substrate, threads on the outer surface of the sleeve or bushing are not used. Rather, the mounting is effected by inserting projecting members into the substrate and soldering them. Namely, the outer surface of the bushing 3' is not threaded in contrast to that of bushing 3 in the embodiment of FIG. 1. A mounting plate 12 is attached to the cover 2, which is similar to that in FIG. 1, and the sleeve 3' is fitted into a circular hole at the center of the plate 12. Two projecting pieces **12*a* are formed on the left edge of the plate 12. The case 1 and its interior elements, including the handle 4, are all the same as those shown in FIG. 1. Contact members 16 and 17 are similar to contacts 6 and 7, respectively. These elements penetrate through and are secured to the bottom wall of the case 1, and after proceeding downwards through the wall are bent at a right angle to the left and terminate at horizontal end portions 16*a* and 17*a*. These end portions and the above-mentioned projecting pieces 12*a* are utilized to mount the switch to a printed substrate in a manner shown in FIG. 8**.

Figure 3:
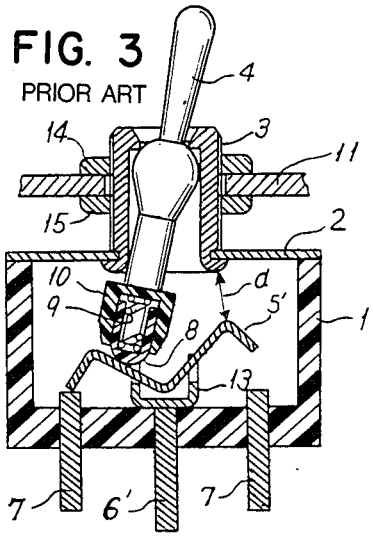
FIG. 3 PRIOR ART
FIG. 3 is a sectional side view of a modified version of the prior art switch shown in FIG. 1.

FIG. 3 illustrates a modification of the switch shown in FIG. 1, the main difference being the use of a modified movable contact member 5' in place of the member 5. More particularly, the switch shown in FIG. 1 is a so-called alternate type, and so the member 5 has a substantially flat shape, while the switch shown in FIG. 3 is a so-called momentary type. In this latter switch the member 5' is bent in the shape of an M, or reversed W, as shown. The alternate type switch is such that when the handle 4 is inclined either to the right or to the left, after it is released, the contact member 5 holds its position by itself. The momentary type switch is such that after the handle 4 is inclined either to the right or to the left, when it is released, the contact member 5' returns automatically to the neutral position. To this end, the contact member 5' is made with its right and left side surfaces having relatively steep inclinations. Further, the central stationary contact member 6' exclusively serves as a terminal, and a bearing member 13 for the contact member 5' is fixedly attached on the upper end of the contact member 6'. This bearing member is channel shaped and its right and left side pieces are shaped, when seen from an end view, so that two posts rise from the right and left side ends of a base member, with the central portion of the contact member 5' being placed in the recess between the two posts. Two nuts 14 and 15 are screwed onto threads formed on the outer surface of the sleeve 3, and a panel 11 is interposed between the two nuts. Thus, by clamping the two nuts from above and below against the panel 11, the switch is attached firmly to the panel. The panel 11 is generally made of iron or aluminum.

In a switch of the type illustrated in FIGS. 1–3, unless the distance between the contact assembly, consisting of the contact members 5, 6, 7, and the metal members surrounding them, including the cover 2 and the bushing 3, is relatively large, there can be a problem with the insulation between them. From this point of view miniaturization of the switch becomes difficult. This is particularly so in the case of the switch shown in FIG. 3. Since the contact member 5' is bent in the shape of the letter M, the distance d between its highest point and the lower end surface of the bushing 3 is apt to be small, and to this point special consideration must be given.

Figure 4:
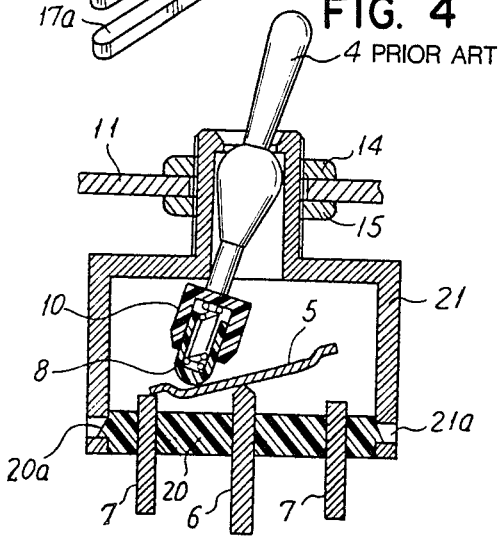
FIG. 4 PRIOR ART
FIG. 4 is a sectional side view of a third type of prior art switch.

In order to improve the above mentioned limitation, heretofore a housing 21 of insulating plastic, as shown in FIG. 4, has been used. This housing is made by molding the case 1, cover 2 and bushing 3 into one body. However, in such a switch the base portion of the case is made separate from the housing 21 as an independent base plate 20 of insulating plastic, to which are secured the contact members 6 and 7. In order to secure the base plate 20 to the housing 21, triangular projections 20*a* on both sides of the base plate are fitted into corresponding holes 21*a* on both sides of the housing.

By using a housing 21 of insulating plastic the switch can be miniaturized, to fairly suit electronic equipment and to contribute to a decrease in the number of parts of the switch and the number of processes for building the switch. On the other hand, however, such construction has a defect in that the electrically conductive handle 4 cannot be grounded. Namely, when the handle 4 is actuated, static electricity which is carried by a human body can change the electrical potential between conductive portions such as the contact members 5, 6 and 7 and the handle 4, thereby inducing abnormal phenomena in circuit characteristics. This static electricity is produced in a human body principally by friction with clothes of chemical fiber or carpets, and can build up to thousands or even ten thousand volts. This static electricity has a bad effect on electrical equipment which uses low voltage or current due to electronization. These phenomena can be seen, for example, in noise or error signals in facsimile equipment, noises in acoustic equipment and error signals in electronic copying machines, etc. In these cases, the panel for mounting switches in the equipment is made of metal, or a separate metal piece is positioned in close proximity to the switch handle to guard against the effects of static electricity. However, these measures have associated disadvantages and sufficient grounding cannot be easily obtained.

THE PRESENT INVENTION

The present invention has its object to eliminate these defects and to this end resides in the concept that in place of making the whole housing 21 of insulating plastic, the switch is constructed of separate portions of insulating plastic and conductive plastic, those portions being integrally combined by molding. The portion of insulating plastic insulates the contact assembly 5, 6, 7 against its surroundings. Similarly, the portion of conductive plastic facilitates the grounding of the handle 4.

Figure 5:
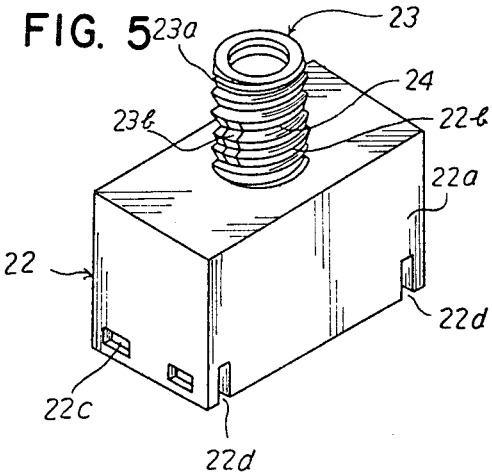
FIG. 5 is a perspective view of a switch embodying the present invention.
Figure 6:
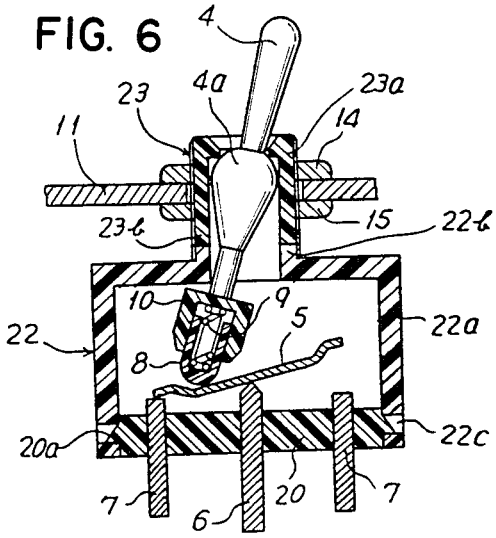
FIG. 6 is a sectional side view of the switch of FIG. 5.

In FIGS. 5 and 6, which show one embodiment of the present invention, the numeral 22 identifies the portion of the housing made of insulating plastic and numeral 23 represents the portion of conductive plastic. The conductive portion 23 consists of a main subportion 23*a* which is disposed above a line 24 and two depending pieces 23*b* which project downwardly from diametrically opposite portions of the bottom surface of subportion 23*a*. The insulating portion 22 consists of a main subportion 22*a* which is shaped as a rectangular case and a subportion 22*b* which projects upwards from the center of the upper surface of 22*a* and constitutes, when combined with the two depending pieces 23*b*, a bushing having a shape substantially similar to the bushing 3 shown in FIG. 1. The two subportions 23*b* and 22*b* are integrally connected by molding.

Two holes 22*c* in the lower portion of each of the right and left side plates of the insulating portion 22 correspond to the holes 21*a* shown in FIG. 4. Projections 20*a* correspondingly provided on a base plate 20 (FIG. 6) are inserted into the holes 22*c* to secure the base plate 20 to the insulating portion 22. In order to facilitate the insertion, two grooves 22*d* are provided on each of the front and rear side plates of the insulating portion 22, whereby the lower end portions of the right and left side plates are separate from the front and rear side plates, and easily flared outwardly.

In the embodiment of FIG. 6, the contact assembly 5, 6, 7 and various elements relating to its operation within the housing 22-23, as well as the connection of the bushing 23-22*b* with a panel 11, are substantially the same as the embodiments of FIGS. 1 or 4. The handle 4 is upwardly biased by the spring 9, and its spherical portion 4*a* is, at is upper surface, in contact with an internal circumferential flange around the upper opening of the bushing 23-22*b*. Further, the conductive portion 23 is in electrical contact, through intervening nuts 14 and 15, with the metallic panel 11. Panel 11 is normally grounded. Therefore, the handle 4 is grounded by way of the contact between its spherical portion 4*a* and the top surface of the conductive portion 23 and further by way of the path from the nuts 14 and 15 to the panel 11. Thus, when a potential induced by static electricity is applied to the lever 4, the electricity is conducted to ground by way of this connection, and has no effect on the concerned electrical equipment.

Under certain circumstances, a water-proof O-ring (ring shaped packing) may be interposed between the flange of the conductive portion 23 and the upper surface of the handle spherical portion 4*a*. In this case, though there exists some clearance between the handle and the bushing, this clearance is minor, and when a high electrical potential is applied therebetween the insulation immediately breaks down and becomes conductive. Alternatively, since the spherical portion 4*a* and the flange of the conductive portion 23 are in relatively close proximity, the small clearance between them becomes similarly conductive, and substantially the same effect is obtained as the case when they are in contact.

Figure 7:
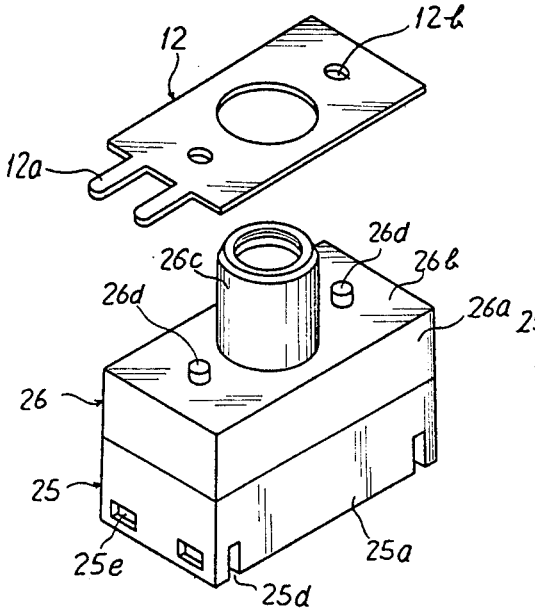
FIG. 7 is a partially exploded perspective view of a second embodiment of the present invention.
Figure 8:
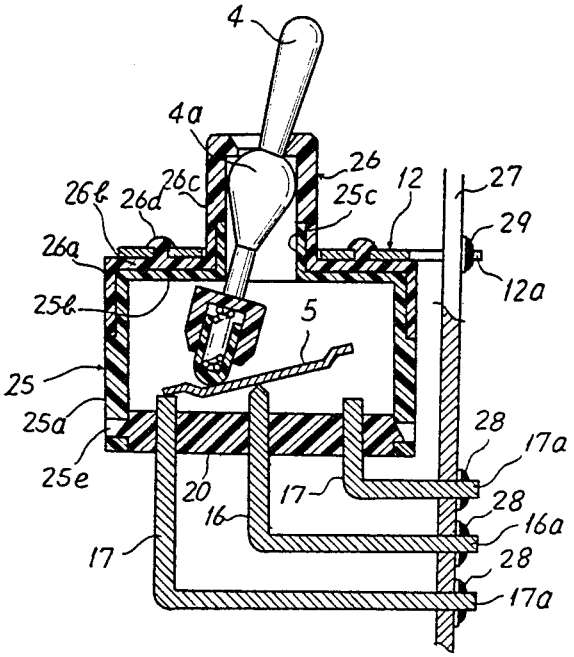
FIG. 8 is a sectional side view of the switch of FIG. 7.

Another embodiment shown in FIGS. 7 and 8 corresponds to the switch shown in FIG. 2. The insulating base plate 20 is the same as that in FIG. 6. The contact members 16 and 17 are similar to those in FIG. 2. They penetrate through the base plate and are secured to it, and the lower portions of the contact members are bent at a right angle to form terminal portions 16*a* and 17*a* at their ends. A portion of insulating plastic 25 consists of an underlying rectangular subportion 25*a*, rectangular plate subportion 25*b* which is integral with the upper end of subportion 25*a* and a short circular cylindrical subportion 25*c* which projects above a central circular hole in the plate 25*b*. A portion of conductive plastic 26 consists of an underlying shorter rectangular subportion 26*a*, a rectangular plate subportion 26*b* which is integral with the upper end of subportion 26*a* and a circular cylindrical subportion 26*c* which projects above a central circular hole in the subportion 26*b*. Portions 25 and 26 are superposed one over the other, and can be made by molding. Therefore, shorter rectangular subportion 26*a* is fitted to and in close contact with the outer surface of a step depression in the upper half of the rectangular subportion 25*a*. Rectangular plate subportion 26*b* is superposed on and in close contact with rectangular plate subportion 25b, and shorter circular cylindrical subportion 25c is fitted to and in close contact with a step depression in the lower inner portion of circular cylindrical subportion 26c. Circular cylindrical subportion 26c and shorter circular cylindrical subportion 25c, when fitted together, correspond to the bushing 3' shown in FIG. 2 and are of the same shape as the latter. The handle spherical portion 4a is received within the circular cylindrical subportion 26c, and is pressed against and in contact with a circumferential flange on the upper end of the subportion 26c by means of a spring 9 within converter 10, similar to the configuration shown in FIG. 1.

As shown in FIG. 7, two holes 25e are provided in each of the right and left sides at their lower ends, in the portion 25 of insulating plastic. A slot 25d is provided at the lower end of each of the right and left sides of the front and rear walls of the portion 25. These holes and slots correspond to holes 22c and slots 22d shown in FIG. 5.

A mounting plate 12 made of metal is placed on conductive plate subportion 26b and is provided with two small holes 12b in addition to the projecting pieces 12a shown in FIG. 2. Correspondingly, two projections 26d are provided on the upper surface of plate subportion 26b. The plate 12 is secured onto plate subportion 26b by inserting projections 26d into holes 12b and heat-caulking their heads. As shown in FIG. 8, the end portions of projections 12a are inserted into holes in a printed substrate 27 and secured thereto by solder 29 at its back side. At the same time, these projections are connected to printed wiring conductors on the back surface of the substrate, which are suitably grounded. Terminals 16a and 17a protruding out from the base plate 20 are also inserted into respective holes of substrate 27 and secured thereto by solder 28 at its back side and at the same time connected to their corresponding printed wiring conductors. In this embodiment, even when static electricity is applied to handle 4, as in the embodiment of FIG. 6, a circuit exists via handle spherical portion 4a, conductive plastic portion 26, mounting plate 12 and solder 29 to ground, to conduct any static electricity to ground. Hence, no bad effects are conveyed to the contact assembly 5, 16, 17 within the housing.

In each of the described embodiments, the conductive plastic can be made by mixing carbon with an insulating plastic. The resistivity of the conductive plastic is preferably about $10^3$–$10^7$ Ωcm. Although this value is higher than that of conventional metal, there is no problem with using it as a conductive material for grounding circuits. It is a material that is generally commercially available and easy to procure. Furthermore, making the housing by molding with two types of plastics, referred to in general as "two color molding", is easy to practice with a two color molding machine, as briefly explained in greater detail with reference to FIGS. 9 and 10.

Figure 9:
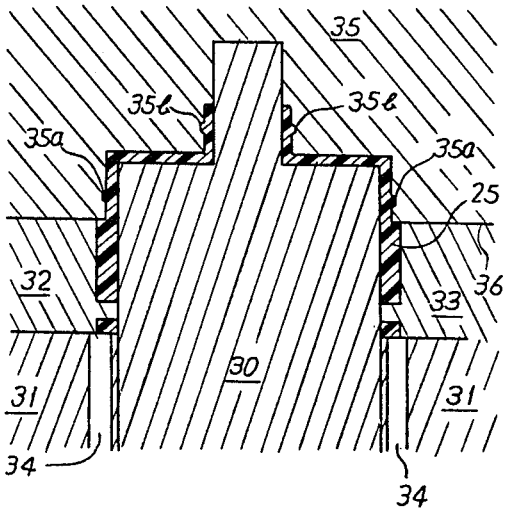
FIGS. 9 and 10 are sectional side views illustrating two steps in the process of manufacturing the switch of FIGS. 7 and 8.
Figure 10:
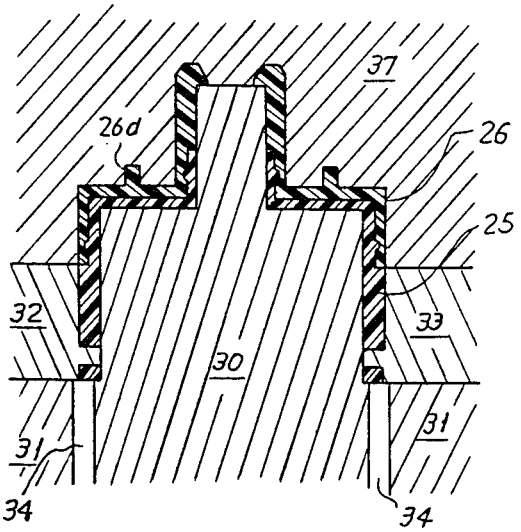

FIG. 9 illustrates a cross-sectional view of equipment for forming the insulating portion 25 and FIG. 10 illustrates a cross-sectional view of equipment for successively forming the conductive portion 26. In FIG. 9, a rectangular core 30 is mounted in the central bore of a core substrate 31. Slide cores 32 and 33 are provided on the left and right sides, respectively, of core 30, and a mold cavity 35 is disposed on the upper surfaces of the slide cores.

In operation, the material of portion 25, namely insulating plastic, is poured into a narrow space formed between the element 30 and the collective elements 32, 33, and 35. After cooling and caking of the material, the mold cavity 35 is separated from the mold parting surface 36, by moving the cavity 35 upwards or the other members downwards, or both. Push-out pins 34 are provided in the substrate 34 at the right and left sides of the lower portion of core 30 to push the product upwards after slide cores 32 and 33 are separated to the left and right, to facilitate removal of the product. The pins are provided one at each of the front and rear sides for each of the right and left sides, amounting to four pins in all. Small depressions 35a are provided on the lower right and left sides of mold cavity 35, and depressions 35b are provided on the right and left sides of the portion having reduced diameter above the depressions 35a. Each of them may have a shape of a small hemisphere or be elongated in a direction perpendicular to the plane of the papers and even extend all around the circumference. The purpose of these depressions is to suitably enforce the connection between portions 25 and 26 when they are superposed as shown in FIG. 10. The projections of the portion 25 corresponding to the depressions can be an obstruction when mold cavity 35 and the portion 25 are separated. However, since the plastic forming the portion 25 has suitable resiliency, the separation is not that difficult.

Referring to FIG. 10, a second mold cavity 37 is placed over core 30, slide cores 32 and 33, and the molded portion 25. A suitable space remains between the formed portion 25 and the cavity 37, into which the material of portion 26, namely conductive plastic, is poured. After it has cooled and caked, mold cavity 37 is moved relatively upward, following which slide cores 32 and 33 are separated out to the left and right. After a little delay, push pin 34 is operated to push out the product. From this product the housing is obtained, in which the portions 25 and 26 are integrally combined.

While the previously described embodiments are of the type in which the bushing 3 is attached to the upper surface of the housing, the present invention is also applicable to a switch in which a bushing is attached to the side surface of the housing. In such a case, for example, a rotary shaft is inserted into the bushing and by rotation of the shaft the converter 10 is shifted to the right and left. In this case the construction of the bushing 23-22b shown in FIG. 5 can be employed as is. In another modification, the present invention can be similarly applied to a wave form (rocker type) switch in which a bushing is not provided but at the same position a wave shaped button (its upper surface is shaped like a wave) is pivotally mounted as a handle. In this case, the rocker button is conductive, for example, being made of conductive plastic.

According to the present invention, a casing for housing a contact assembly of a switch can be easily miniaturized without compromising the insulation for the contact assembly. Furthermore, grounding of a conductive handle for operating the contact assembly can be easily provided so that static electricity which can be applied to the handle and become a possible source of error in operation can be immediately conducted to ground.

It will be appreciated by those of ordinary skill in the art that the present invention can be embodied in other specific forms without departing from the spirit or essential characteristics thereof. The presently disclosed embodiments are therefore considered in all respects to be illustrative and not restrictive. The scope of the invention is indicated by the appended claims rather than the foregoing description, and all changes that come within the meaning and range of equivalents thereof are intended to be embraced therein.

What is claimed is:

1. A low-power switch, comprising:

an insulating base plate having mounted thereon a switching contact assembly;

a housing which overlies and covers said base plate, said housing comprising a first portion made of insulating plastic which surrounds said switching contact assembly and a second portion made of conductive plastic which is contiguous and integrally molded with said first portion so as to form a single body and adapted to be placed in electrical contact with a grounding conductor; and an electrically conductive handle disposed within an aperture in said second portion of said housing and in electrical contact therewith, and insulated from said switching contact assembly by said first portion, for actuating said switching contact assembly.

2. The switch of claim 1 wherein said first and second portions of said housing are fitted together by means of a projection on one of said portions and a complementary recess in the other of said portions.

3. The switch of claim 1 wherein said second portion forms a bushing which projects from said housing and from which said handle emerges, and is adapted for connection with a grounded conductor by means of external threads on said bushing.

4. The switch of claim 1 further including an electrically conductive plate mounted on said second portion for connection to a grounded conductor.

5. A low-power switch, comprising:

an insulating base plate having mounted thereon a switching contact assembly;

a housing which overlies and covers said base plate, said housing comprising a first portion made of insulating plastic which surrounds said switching contact assembly and a second portion made of conductive plastic which is contiguous with said first portion;

an electrically conductive plate mounted on said second portion for connection to a grounded conductor;

projections on said second portion for insertion into apertures in said plate to mount the plate on said second portion; and an electrically conductive handle disposed within an aperture in said second portion of said housing and in electrical contact therewith, and insulated from said switching contact assembly by said first portion, for actuating said switching contact assembly.

* * * * *